US005919385A

United States Patent [19]

Kersten et al.

[11] Patent Number: 5,919,385

[45] Date of Patent: Jul. 6, 1999

[54] COOKING APPARATUS

[75] Inventors: Reinhard Kersten, Aachen; Heinz Körver, Übach-Palenberg, both of Germany

[73] Assignee: U.S. Phillips Corporation, New York, N.Y.

[21] Appl. No.: 08/585,007

[22] Filed: Jan. 11, 1996

[30] Foreign Application Priority Data

Jan. 7, 1995 [DE] Germany ..... 195 00 351

[51] Int. Cl.[6] ..... H05B 3/68

[52] U.S. Cl. ..... 219/448.11; 219/460.1

[58] Field of Search ..... 219/448, 449, 219/452, 461, 464

[56] References Cited

U.S. PATENT DOCUMENTS

| | | | |
|---|---|---|---|
| 4,414,465 | 11/1983 | Newton et al. | 219/449 |
| 4,816,647 | 3/1989 | Payne | 219/464 |
| 4,851,645 | 7/1989 | Wolf et al. | 219/449 |
| 4,864,104 | 9/1989 | Crossley et al. | 219/464 |
| 5,183,997 | 2/1993 | Lotz | 219/464 |
| 5,223,697 | 6/1993 | Wilde et al. | 219/464 |
| 5,243,172 | 9/1993 | Hazan et al. | 219/448 |
| 5,296,682 | 3/1994 | Wittauer et al. | 219/464 |
| 5,491,423 | 2/1996 | Turetta | 219/448 |

FOREIGN PATENT DOCUMENTS

| | | |
|---|---|---|
| 0037638B1 | 3/1981 | European Pat. Off. . |
| 0S3842033 | 12/1988 | Germany . |
| PS1574167 | 11/1977 | United Kingdom . |

*Primary Examiner*—Teresa Walberg
*Assistant Examiner*—Sam Paik
*Attorney, Agent, or Firm*—Ernestine C. Bartlett; Norman N. Spain

[57] ABSTRACT

A cooking apparatus comprises a glass-ceramic plate, at least one heat radiator arranged underneath the plate, at least one sensor arranged underneath the plate in an area which is shielded from the heat radiation, for measuring the temperature in this area, and a device for controlling the heating power in dependence upon signals supplied by the sensor. A simple and reliable method of measuring the temperature of the bottom of the cooking vessel can be obtained when, in the cooking apparatus the heat radiator is a halogen lamp system and the hotplate is a ceramic plate which is highly transparent to halogen-lamp radiation and has a degree of absorption of approximately ≦40%, the sensor engages against the underside of the ceramic plate, and the control device comprises an element for selecting a nominal.

62 Claims, 2 Drawing Sheets

COOKING APPARATUS

The invention relates to a cooking apparatus comprising a glass-ceramic plate, at least one heat radiator arranged underneath the plate, at least one sensor arranged underneath the plate in an area which is shielded from the heat radiation, for measuring the temperature in this area, and a device for controlling the heating power in dependence upon signals supplied by the sensor.

The invention further relates to a system comprising a cooking apparatus and a cooking vessel, as well as to a method of carrying out process control.

A cooking apparatus of the type defined in the opening paragraph is known from, for example, EP 0 037 638 B1. In this known construction the sensor is disposed below and spaced from the hotplate and is arranged in a cylindrical shield which extends from the hotplate to the bottom of the cooking apparatus. The cylindrical shield is offset with respect to the center of the hotplate. When a pan is placed on the hotplate the pan is heated and, as a result, the circular area of the hotplate bounded by the shield is also heated. Since this area of the hotplate is shielded from direct heat radiation by means of this shield its temperature will correspond to that of the pan, so that the temperature measured by the sensor in the shielded area of the hotplate generates a signal corresponding to the temperature of the pan. However, if a glass-ceramic plate is used, which absorbs a substantial part of the applied heat radiation, the signal supplied by the sensor will be invalidated by the transverse heat conduction.

GB-PS 1 574 176 discloses a cooking apparatus comprising a glass-ceramic plate and a flat heating zone arranged underneath the glass-ceramic plate and comprising electrical resistance heating elements. At its periphery the heating zone has an indentation in which a temperature sensor is arranged, which in this construction is in direct thermal contact with the glass-ceramic plate. With this construction the sensor is not shielded.

The principal problem with the conventional ceramic cooking fields described above is the substantial overheating of the ceramic material in the heat transfer range, which lies at substantially 500° C. This substantial overheating is caused by the fact that the ceramic material used until now does not transmit but absorbs a major part of the heat applied from underneath. As a result, a sensor arranged on the ceramic plate does not measure the temperature of the pan placed on it but a temperature which is mainly determined by the absorbed radiation power, or which in the case of shielding is invalidated by so-called transverse heat conduction from the overheated adjacent areas. Thus, this measurement value cannot provide an unambiguous measure of the temperature of the pan bottom. This often leads to an excessive pan temperature being simulated in the case of these ceramic cooking fields, the misrepresentation being even increased if there is no intimate contact but a larger or smaller air gap between the pan bottom and the ceramic surface. This is often so with the commercially available electric pans, which are not flat but which have concave curvatures of approximately 0.3 to 1 mm in their centers. Such concave curvatures of commercially available electric pans serve to avoid that during of heating on conventional electric cook-tops the pan bottom bulges outwards to an impermissible extent and the pan thus "bounces" on the cook-top.

For many years the widely known mass-produced cook-tops, made of for example cast iron, have used a contact sensor arranged in a bore in the cook-top, which sensor is spring-loaded against the bottom of a pan placed onto the cook-top. This enables an automatic cooking process to be obtained by means of a two-point or three-point control. A disadvantage is the poor controllability of these mass-produced cook-tops owing to the appreciable thermal inertia, as a result of which these cook-tops are supplanted more and more by glass-ceramic cooking equipment. However, the arrangement of sensors in a bore of the cook-top as known from these mass-produced cook-tops is impossible with glass-ceramic cook-tops because such a bore would considerably affect the mechanical stability and resistance to shocks and because the smooth and attractive appearance of the surface would be disturbed by the bores and the surface would be difficult to clean.

DE-OS 38 42 033 describes a light cooking device whose heating source is a halogen radiator. Use is made of a glass-ceramic plate whose typical operating temperature is only half that of conventional thermal ranges owing to the substantially reduced absorption. This reduces the undesired transverse heat conduction within the glass-ceramic plate. The halogen radiator comprises two halogen lamps arranged above a specially shaped reflector. The reflector is made of aluminum and consequently has a very high degree of reflection. It is possible to use aluminum because most of the thermal power produced by the halogen radiators penetrates through the glass-ceramic plate and, as consequence, no excessive temperatures can occur underneath the glass-ceramic plate and cause damage to the aluminum reflector.

It is an object of the invention to construct a cooking apparatus of the type defined in the opening paragraph so as to enable a reliable measurement of the temperature of the pan bottom by means of the sensor arranged underneath the glass-ceramic plate.

According to the invention this object is achieved in that the heat radiator is a halogen lamp system and the hotplate is a ceramic plate which is highly transparent to halogen-lamp radiation and has a degree of absorption of approximately $\leqq 40\%$, the sensor engages against the underside of the ceramic plate, and the control device comprises an element for selecting a nominal temperature.

Such a construction, in combination with a suitable controller which is known per se, for the first time allows a satisfactory process control of cooking processes, particularly temperature-controlled processes, such as for example grilling, oil fondue, cheese fondue or chocolate coating. Owing to the reduced absorption the typical operating temperatures are only substantially half those of conventional thermal ranges, which results in a low transverse heat conduction, whose adverse effect on the temperature measured by the sensor is smaller. A further advantage of the use of such glass-ceramic materials is that the use of halogen radiators as heat radiators precludes an excessive heat generation underneath the glass-ceramic plate. Thus, the reduced absorption of these glass-ceramic plates has the advantage of a reduced transverse heat conduction inside the plate and a reduced generation of heat underneath the ceramic plate.

In addition, such halogen radiators further have the advantage that in the ideal case, i.e. without absorption by the ceramic plate, the entire thermal power produced by the halogen radiators is available. In practice, a smaller portion is absorbed as compared with the ceramic hotplates known until now, the major part being directly available as heating power at the pan bottom, so that all heating processes start with this available power and the power is constantly limited at the selected nominal temperature. The operation is such that after the pan with the substance to be heated has been placed onto the ceramic cook-top only the process temperature is selected. Subsequently, the change-over from warming up to the correct steady power at the desired process temperature proceeds automatically without manual intervention. If desired, an individual correction can be applied in a simple manner in that a different process temperature is selected. The operating temperature is substantially maintained in the case of load variations, which is important for example in the case of grilling, meat fondue or roasting. Unnecessary odours produced by, for example smoking oil, are avoided. Since the temperature of the bottom of the pan is controlled, delicate substances are treated very carefully in that excess temperatures are avoided. Fondue oil degrades more slowly, cheese fondue does not curdle, and chocolate coating is treated carefully as in a bain-marie. This is a great advantage in comparison with control systems operating, for example, with a sensor immersed in the substance to be cooked, because the full power is then applied substantially until the final temperature is reached, which is attended with a significant overheating of the bottom boundary layer.

A further advantage of the cooking apparatus in accordance with the invention is that when a pan with a non-flat bottom is used or when the ceramic cooking field is turned on without a pan having been put on, the power is usually limited automatically without any damage being incurred. This means that a pan with a non-flat bottom is automatically controlled at a lower power than a pan with a flat bottom. Moreover, the residual transverse heat conduction inside the ceramic plate limits the power of the ceramic cooking field in the case that no pan has been placed onto the ceramic plate with the radiant heat radiator turned on.

In the case of load variations, for example upon the introduction of meat into an oil fondue, the system will provide automatic readjustment and will attempt to maintain the optimum temperature.

Thus, after turning on the power and selection of a desired temperature the user of the cooking apparatus in accordance with the invention may attend to other things without having to worry about the apparatus getting out of control. However, if desired, the user can intervene according to his taste and select a new temperature setting.

In an embodiment of the invention the halogen lamp system has been provided with a reflector of aluminum. The use of the ceramic material with a lower absorption also results in a reduced heating underneath the hotplate, so that there is no risk that the aluminum reflector is damaged. Aluminum has a very high degree of reflection, so that most of the heat flow generated by the halogen radiators is reflected in an upward direction towards the ceramic plate.

In a further embodiment of the invention the sensor is resiliently urged against the underside of the ceramic plate. This construction permits a simple mounting without an intricate fastening.

In a further embodiment of the invention the desired temperature can be selected simply in that there has been provided a rotary knob with appropriate symbols. This knob may, for example, be combined with the on/off switch. The desired temperature can also be set by means of a switch combination comprising a plurality of pushbutton switches.

In a further embodiment of the invention the sensor is shielded from the radiation by means of a tube made of a highly-reflecting material. This ensures that the temperature to be detected by the sensor is influenced to a minimal extent by the heat radiated by the heat radiator.

In a further embodiment of the invention, in order to ensure that the peripheral areas of the aluminum tube which are influenced by the thermal radiation have a minimal influence on the sensor arranged inside the tube, the diameter of the shielding tube is so large relative to the contact area of the sensor that the peripheral areas of the tube heated by the heat radiation have no perceptible influence on the temperature to be detected by means of the sensor.

It has been found that in the case of a sensor diameter of a few millimeters a tube diameter of approximately 15 to 30 mm is optimum.

In a further embodiment of the invention, in order to minimize the influence of the air gap between the hotplate and the curved bottom of a pan, the sensor is disposed eccentrically at the periphery of the cooking field.

In accordance with a further characteristic feature of the invention it is proposed that in a system comprising a cooking apparatus in accordance with the invention and associated cooking vessels (for example, pans of different types, grill plate) the bottom of the pan is as flat as possible. Thus, it is achieved that the air gap between the pan bottom and the ceramic plate is very small and uniform, so that the heat generated by the heat radiator can reach the pan bottom without hindrance. It has been found that small air gaps up to approximately 0.4 mm between the upper side of the ceramic plate and the pan bottom are still acceptable and allow the pan bottom temperature to be determined with satisfactory accuracy.

Very good results are obtained if in said system the pan bottom is black in order to minimize the amount of radiation that can be reflected towards the sensor. This eliminates another error source affecting the temperature detected by the sensor.

A method of carrying out process control with a cooking apparatus of the above type is characterized in that the temperature signals supplied by the sensor are continually compared with the selected nominal temperature, and the values determined by means of this comparison are converted to a power setting to be maintained. Such a method enables automatic process control without the risk of overheating. All heating processes are started automatically and in the ideal case with the full power that is available and the power is constantly limited at the selected nominal temperature.

The continual comparison of the measured actual temperature with the desired temperature is effected, for example, at intervals of 2.5 s. It has been found that such a measurement yields satisfactory results.

In a further embodiment of the invention, when a commercially available controller (PID controller) is used, the values of the controller are set in such a manner that in view of the large deviation between the nominal temperature and the actual temperature at the beginning of the process the full power is maintained until the sensor temperature has reached the nominal temperature minus approximately 25° K, and the power is subsequently reduced and is continually adapted to the instantaneous requirement.

Embodiments of the invention will now be described in more detail, by way of example, with reference to the accompanying diagrammatic drawings. In the drawings:

FIG. 1 shows a cooking apparatus comprising a highly transparent glass-ceramic plate 10 and a halogen radiator 11 arranged underneath the plate 10 and comprising two halogen lamps 12, which are disposed at either side of the plane of the drawing, and an aluminum reflector 13. A temperature sensor 14 is disposed between the lamps 12 in a peripheral area of the cooking field and is shielded from the heat radiation emitted by the halogen lamps 12 by means of a cylindrical aluminum tube 15.

Figure 2:
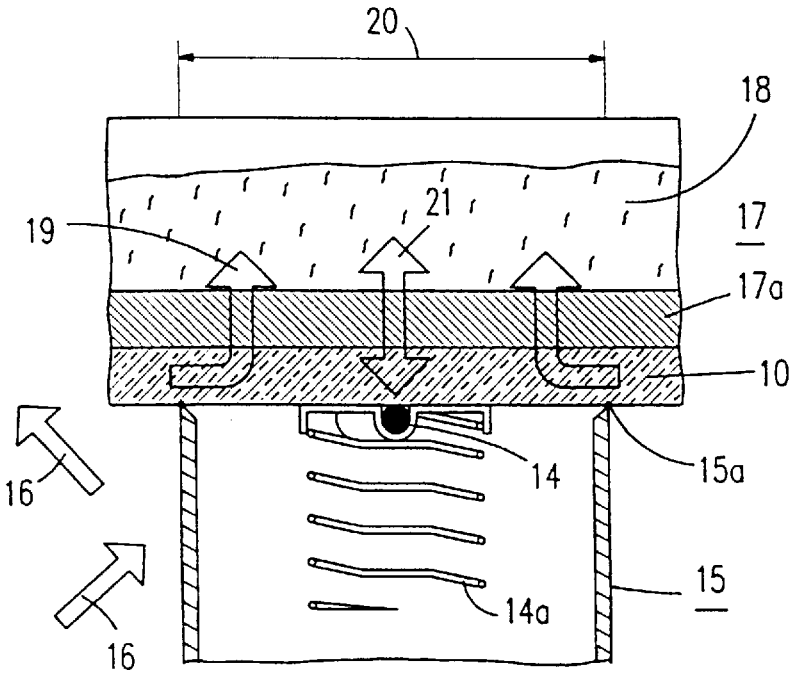
FIG. 2 shows a part of a first embodiment in the area of the sensor.

As is shown in FIG. 2, the sensor 14 is urged against the glass-ceramic plate 10 by means of a spring 14*a*. A pan 17 containing a liquid 18 is disposed on the glass-ceramic plate. In the present embodiment the pan bottom 17*a* is black and there is substantially no air gap between the pan bottom and the glass-ceramic plate. With such a configuration the sensor 14 is shielded from the heat radiation 16 by the shielding tube 15. Most of the radiation 16 which impinges on the glass-ceramic plate 10 outside the shielding tube 15 is transmitted directly to the pan bottom 17*a*. A lateral heat flow 19 is dictated by the transverse heat conduction, which heat flow is very small as a result of the low absorption of such glass-ceramic plates and owing to the black pan bottom and the good contact (very small air gap) in the shielding area 20 is kept away from the sensor 14 and is directed towards the pan bottom 17*a*. The sensor 14 detects the heat flow 21 coming from the pan bottom 17*a*.

Figure 3:
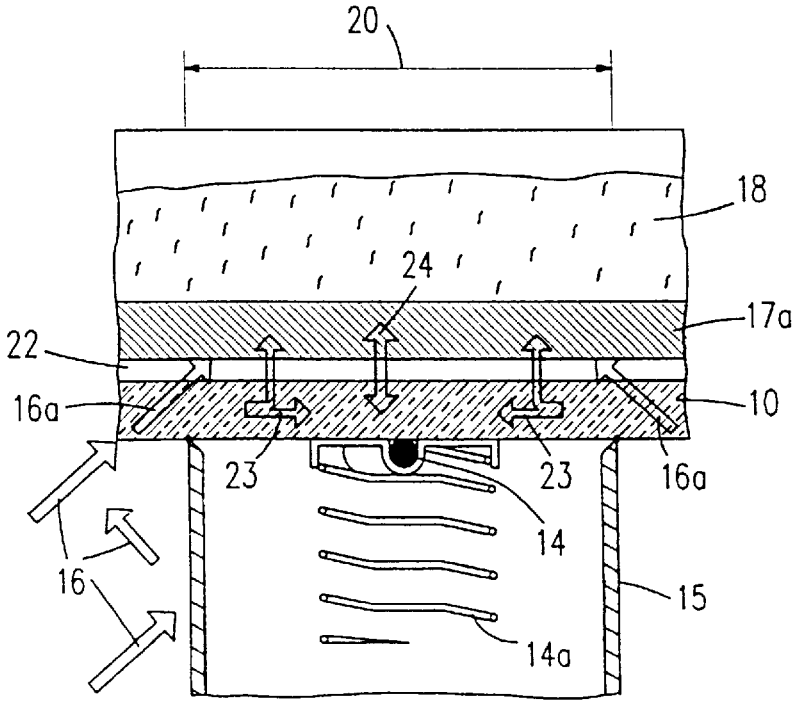
FIG. 3 shows a part of a second embodiment, also in the area of the sensor.

FIG. 3 shows an embodiment corresponding to that shown in FIG. 2 but in which there is an air gap 22 between the pan bottom 17*a* and the glass-ceramic plate 10. The heat radiation 16 available outside the shielding tube 15 can reach the pan bottom 17*a* partly along the shielding tube 15. If the pan bottom is black the radiation is absorbed and thus cannot reach the sensor 14 and invalidate the measurement result. As it passes the shielding tube the heat produced in the glass-ceramic plate 10 by the heat radiation 16 outside the shielding area 20 is more or less obstructed by the air gap 22 to flow off into the pan bottom 17*a*. This results in a slightly larger heat flow 23 towards the sensor 14 in this arrangement. Thus, in the present embodiment a slight increase of the temperature measured by the sensor 14 may occur but, as experience shows, this remains within narrow limits in the case of air gaps smaller than approximately 0.4 mm and a black pan bottom. Thus, the sensor 14 mainly measures the heat flow 24 from the pan bottom 17*a*.

Figure 1:
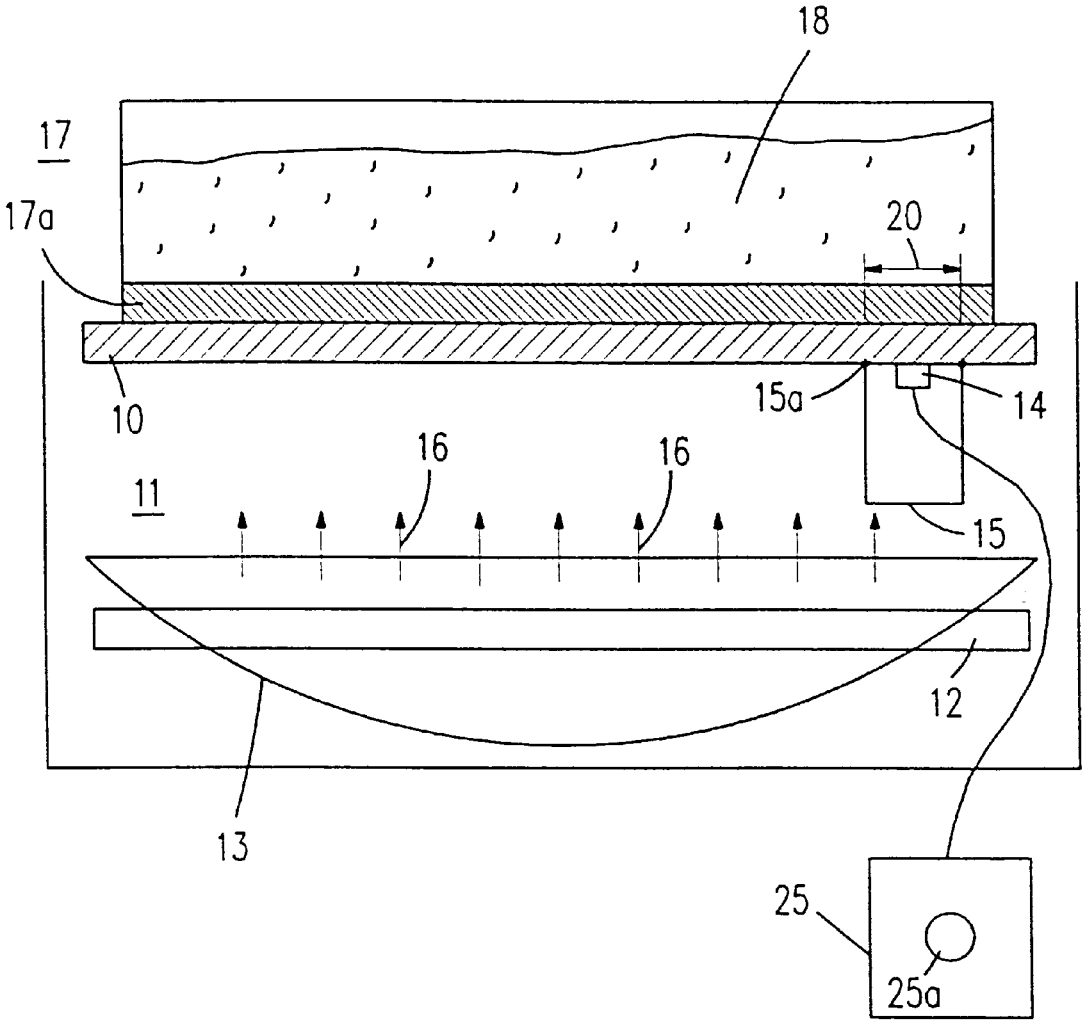
FIG. 1 shows a cooking apparatus in accordance with the invention comprising a sensor arranged underneath a glass-ceramic plate.

The cooking apparatus shown in FIGS. 1 to 3 comprises a control device shown diagrammatically in FIG. 1 and having a rotary knob 25*a* for setting a nominal temperature.

We claim:

1. A cooking apparatus comprising:

a glass-ceramic plate (10), at least one heat radiator arranged beneath the plate, at least one sensor (14) arranged underneath the plate (10), in an area (20) which is shielded from heat radiation (16) from said at least one heat radiator, for measuring the temperature of the plate (10) in this area, and a control device (25) for controlling heating power of said at least one heat radiator in dependence upon signals supplied by the sensor (14), characterized in that:

the at least one heat radiator is a halogen lamp system (12), the glass-ceramic plate (10) is of a composition such that it is highly transparent to halogen lamp radiation and has a degree of absorption of said radiation of approximately ≦40%, the sensor (14) engages against the underside of the plate (10), the area (20) is shielded from the heat radiation (16) essentially only by a shielding tube (15) enclosing the area (20), and the control device (25) comprises an element (25*a*) for selecting a nominal temperature.

2. A cooking apparatus as claimed in claim 1, characterized in that the halogen lamp system (12) has been provided with a reflector (13) of aluminum.

3. A cooking apparatus as claimed in claim 2, characterized in that the sensor (14) is resiliently urged against the underside of the ceramic plate (10).

4. A cooking apparatus as claimed in claim 2 characterized in that the nominal temperature can be selected by means of a single rotary knob (25*a*) provided with symbols, at option in combination with the on/off switch.

5. A cooking apparatus as claimed in claim 2 characterized in that the nominal temperature can be selected by means of a switch combination comprising a plurality of pushbutton switches.

6. A cooking apparatus as claimed in claim 2 characterized in that the sensor (14) is shielded from the radiation (16) by means of a tube (15) made of a highly-reflecting material.

7. A cooking apparatus as claimed in claim 6, characterized in that the diameter of the shielding tube (15) is of the order of 15 to 30 mm in the case that the sensor (14) has a diameter of a few millimeters.

8. A cooking apparatus as claimed in claim 2 characterized in that the sensor (14) is disposed eccentrically at the periphery of the cooking field.

9. A method of carrying out process control with a cooking apparatus as claimed in claim 2 characterized in that the temperature signals supplied by the sensor (14) are continually compared with the selected nominal temperature, and the values determined by means of this comparison are converted to a power setting to be maintained.

10. A cooking apparatus as claimed in claim 3 characterized in that the nominal temperature can be selected by means of a single rotary knob (25*a*) provided with symbols, at option in combination with the on/off switch.

11. A cooking apparatus as claimed in claim 3 characterized in that the nominal temperature can be selected by means of a switch combination comprising a plurality of pushbutton switches.

12. A cooking apparatus as claimed in claim 3 wherein the sensor (14) is shielded from the radiation (16) by means of a tube (15) made of a highly-reflecting material.

13. A cooking apparatus as claimed in claim 12, characterized in that the diameter of the shielding tube (15) is of the order of 15 to 30 mm in the case that the sensor (14) has a diameter of a few millimeters.

14. A cooking apparatus as claimed in claim 3 characterized in that the sensor (14) is disposed eccentrically at the periphery of the cooking field.

15. A method of carrying out process control with a cooking apparatus as claimed in claim 3 characterized in that the temperature signals supplied by the sensor (14) are continually compared with the selected nominal temperature, and the values determined by means of this comparison are converted to a power setting to be maintained.

16. A cooking apparatus as claimed in claim 1, characterized in that the nominal temperature can be selected by means of a single rotary knob (25*a*) provided with symbols, at option in combination with the on/off switch.

17. A cooking apparatus as claimed in claim 16 characterized in that the sensor (14) is shielded from the radiation (16) by means of a tube (15) made of a highly-reflecting material.

18. A cooking apparatus as claimed in claim 17, characterized in that the diameter of the shielding tube (15) is of the order of 15 to 30 mm in the case that the sensor (14) has a diameter of a few millimeters.

19. A cooking apparatus as claimed in claim 16 characterized in that the sensor (14) is disposed eccentrically at the periphery of the cooking field.

20. A method of carrying out process control with a cooking apparatus as claimed in claim 16 characterized in that the temperature signals supplied by the sensor (14) are continually compared with the selected nominal temperature, and the values determined by means of this comparison are converted to a power setting to be maintained.

21. A cooking apparatus as claimed in claim 1, characterized in that the nominal temperature can be selected by means of a switch combination comprising a plurality of pushbutton switches.

22. A cooking apparatus as claimed in claim 21 characterized in that the sensor (14) is shielded from the radiation (16) by means of a tube (15) made of a highly-reflecting material.

23. A cooking apparatus as claimed in claim 21, characterized in that the diameter of the shielding tube (15) is of the order of 15 to 30 mm in the case that the sensor (14) has a diameter of a few millimeters.

24. A cooking apparatus as claimed in claim 21 wherein the sensor (14) is disposed eccentrically at the periphery of the cooking field.

25. A method of carrying out process control with a cooking apparatus as claimed in claim 21 characterized in that the temperature signals supplied by the sensor (14) are continually compared with the selected nominal temperature, and the values determined by means of this comparison are converted to a power setting to be maintained.

26. A cooking apparatus as claimed in claim 1, characterized in that the sensor (14) is shielded from the radiation (16) by means of a tube (15) made of a highly-reflecting material.

27. A cooking apparatus as claimed in claim 26 wherein the sensor (14) is disposed eccentrically at the periphery of the cooking field.

28. A method of carrying out process control with a cooking apparatus as claimed in claim 26 characterized in that the temperature signals supplied by the sensor (14) are continually compared with the selected nominal temperature, and the values determined by means of this comparison are converted to a power setting to be maintained.

29. A cooking apparatus as claimed in claim 26 characterized in that the diameter of the shielding tube (15) is so much larger than that of the area of the sensor (14) in contact with the underside of the plate (10) that the peripheral areas **(15*a*) of the tube (15) heated by the heat radiating from the heat radiator (11) have no perceptible influence on the temperature detectable by means of the sensor (14)**.

30. A cooking apparatus as claimed in claim 29, characterized in that the diameter of the shielding tube (15) is of the order of 15 to 30 mm in the case that the sensor (14) has a diameter of a few millimeters.

31. A cooking apparatus as claimed in claim 29 wherein the sensor (14) is disposed eccentrically at the periphery of the cooking field.

32. A method of carrying out process control with a cooking apparatus as claimed in claim 29 characterized in that the temperature signals supplied by the sensor (14) are continually compared with the selected nominal temperature, and the values determined by means of this comparison are converted to a power setting to be maintained.

33. A cooking apparatus as claimed in claim 29 wherein the halogen lamp system (12) is provided with a reflector (13) of aluminum.

34. A cooking apparatus as claimed in claim 29 wherein the sensor (14) is resiliently urged against the underside of the plate (10).

35. A cooking apparatus as claimed in claim 29, wherein a single rotary knob **(25*a*)**, provided with symbols, and optionally in combination with an on/off switch, is provided for selecting the nominal temperature.

36. A cooking apparatus of claim 29, wherein a switch combination comprising a plurality of push-button switches is provided for selecting the nominal temperature.

37. A cooking apparatus as claimed in claim 29, characterized in that the diameter of the shielding tube (15) is of the order of 15 to 30 mm in the case that the sensor (14) has a diameter of a few millimeters.

38. A cooking apparatus as claimed in claim 37 wherein the sensor (14) is disposed eccentrically at the periphery of the cooking field.

39. A method of carrying out process control with a cooking apparatus as claimed in claim 37 characterized in that the temperature signals supplied by the sensor (14) are continually compared with the selected nominal temperature, and the values determined by means of this comparison are converted to a power setting to be maintained.

40. A cooking apparatus as claimed in claim 1, characterized in that the sensor (14) is disposed eccentrically at the periphery of the cooking field.

41. A method of carrying out process control with a cooking apparatus as claimed in claim 40 characterized in that the temperature signals supplied by the sensor (14) are continually compared with the selected nominal temperature, and the values determined by means of this comparison are converted to a power setting to be maintained.

42. A method of carrying out process control with a cooking apparatus as claimed in claim 1, characterized in that the temperature signals supplied by the sensor (14) are continually compared with the selected nominal temperature, and the values determined by means of this comparison are converted to a power setting to be maintained.

43. A method as claimed in claim 42 utilizing a commercially available controller, for example a PID controller, characterized in that the values of the controller are set in such a manner that in view of the large deviation between the nominal temperature and the temperature at the beginning of the process the full power is maintained until the sensor temperature has reached the nominal temperature minus approximately 25° K, and the power is subsequently reduced and is continually adapted to the instantaneous requirement.

44. A method of carrying out process control with a cooking apparatus as claimed in claim 1 characterized in that the temperature signals supplied by the sensor (14) are continually compared with the selected nominal temperature, and the values determined by means of this comparison are converted to a power setting to be maintained.

45. A cooking system comprising a cooking vessel (17, for example a pan), means for heating said vessel (17) comprising:

a glass ceramic plate (10) arranged below the cooking vessel (17), at least one heat radiator (11) arranged underneath the plate (10), at least one sensor (14) arranged underneath the plate (10) in an area (20) which is shielded from heat radiation (16) from the heat radiator (11), for measuring the temperature in said area, and a device (25) for controlling power for the heat radiator (11) in dependence upon signals supplied by the sensor (14), characterized in that the heat radiator (11) is a halogen lamp system (12), the glass-ceramic plate (10) is of a composition that is highly transparent to radiation (16) from the halogen lamp system (12) and has a degree of absorption of said radiation of approximately <40%, the sensor (14) engages against the underside of the plate (10), the control device (25) comprises an element (25*a*) for selecting a nominal temperature and the vessel (17) has a bottom (17*a*) that is as flat as possible so as to provide a minimum air gap between it and the upper side of the plate (10).

46. A system as claimed in claim 45, characterized in that the air gap between the upper side of the glass-ceramic plate (10) and the vessel bottom (17*a*) is ≦0.4 mm.

47. A system as claimed in claim 45, characterized in that the vessel bottom (17*a*) is black.

48. A cooking system of claim 45, wherein the halogen lamp system (12) is provided with a reflector (13) of aluminum.

49. A cooing system of claim 45, wherein the sensor (14) is recently urged against the underside of the ceramic plate (10).

50. A cooking system of claim 45, wherein the device (25) for controlling power is provided with an on/off switch and a single rotary knob (25*a*), provided with symbols, is provided for selecting the nominal temperature, optionally in combination with the on/off switch.

51. A cooking system of claim 45, wherein a switch combination comprising a plurality of push-button switches is provided for selecting the nominal temperature.

52. A cooking system of claim 45, wherein the sensor (14) is shielded from the heat radiation (16) by means of a tube (15) made of a highly-reflecting metal.

53. A cooking system of claim 45, wherein the tube (15) has a diameter that is so much larger than the area of the sensor (14) in contact with the underside of the plate (10) that peripheral areas (15*a*) of the tube (15) heated by the heat radiation have no perceptible influence on the temperature detectable by the sensor (14).

54. A cooking system of claim 53, wherein the diameter of the tube (15) is about 15–30 mm and the diameter of the sensor (14) is a few millimeters.

55. A cooking system of claim 45, wherein the sensor (14) is disposed eccentrically a the periphery of the cooking field.

56. A cooking system of claim 45, wherein the bottom (17*a*) of the vessel (17) is as flat as possible.

57. A cooking system of claim 56, wherein an air gap of <0.4 mm is present between the bottom (17*a*) of the vessel and the plate (10).

58. A cooking system of claim 57 wherein the bottom (17*a*) of the vessel (17) is black.

59. A cooking apparatus as claimed in claim 6 wherein the diameter of the shielding tube (15) is so much larger than the area of the sensor in contact with the underside of the plate (10) that the peripheral areas (15*a*) of the tube (15) heated by the heat radiating from the heater radiator (11) have no perceptible influence on the temperature detectable by means of the sensor (14).

60. A cooking apparatus as claimed in claim 12 wherein the diameter of the shielding tube (15) is so much larger than the area of the sensor in contact with the underside of the plate (10) that the peripheral areas (15*a*) of the tube (15) heated by the heat radiating from the heater radiator (11) have no perceptible influence on the temperature detectable by means of the sensor (14).

61. A cooking apparatus as claimed in claim 17 characterized in that the diameter of the shielding tube (15) is so much larger than the area of the sensor in contact with the underside of the plate (10) that the peripheral areas (15*a*) of the tube (15) heated by the heat radiating from the heater radiator (11) have no perceptible influence on the temperature detectable by means of the sensor (14).

62. A cooking apparatus as claimed in claim 22 characterized in that the diameter of the shielding tube (15) is so much larger than the area of the sensor in contact with the underside of the plate (10) that the peripheral areas (15*a*) of the tube (15) heated by the heat radiating from the heater radiator (11) have no perceptible influence on the temperature detectable by means of the sensor (14).

* * * * *